US010258183B2

(12) United States Patent
Zsarik

(10) Patent No.: US 10,258,183 B2
(45) Date of Patent: Apr. 16, 2019

(54) CURTAIN CHANGING APPARATUS AND METHOD OF USE THEREOF

(71) Applicant: Miami Design Pty Ltd, Airport West, Victoria (AU)

(72) Inventor: John Zsarik, Airport West (AU)

(73) Assignee: MIAMI DESIGN PTY LTD, Victoria (AU)

( * ) Notice: Subject to any disclaimer, the term of this patent is extended or adjusted under 35 U.S.C. 154(b) by 0 days.

(21) Appl. No.: 15/737,654

(22) PCT Filed: Jun. 20, 2016

(86) PCT No.: PCT/AU2016/000209
§ 371 (c)(1),
(2) Date: Dec. 18, 2017

(87) PCT Pub. No.: WO2016/201488
PCT Pub. Date: Dec. 22, 2016

(65) Prior Publication Data

US 2018/0168381 A1 Jun. 21, 2018

(30) Foreign Application Priority Data

Jun. 18, 2015 (AU) ..... 2015902341

(51) Int. Cl.
*A47H 1/04* (2006.01)
*A47H 1/08* (2006.01)
(Continued)

(52) U.S. Cl.
CPC ..... *A47H 1/08* (2013.01); *A47H 1/04* (2013.01); *A47H 15/04* (2013.01); *A61G 12/00* (2013.01);
(Continued)

(58) Field of Classification Search
CPC .... A47H 13/01; A47H 2015/005; A47H 1/08; A47H 1/04; A47H 15/04;
(Continued)

(56) References Cited

U.S. PATENT DOCUMENTS 4,089,553 A * 5/1978 Frykholm ..... B25J 1/04 294/104
4,708,189 A * 11/1987 Ward ..... E04B 2/7407 160/330
(Continued)

FOREIGN PATENT DOCUMENTS

CH 682537 10/1993
DE 30 39 942 5/1982
(Continued)

OTHER PUBLICATIONS

International Search Report dated Oct. 20, 2016 issued in PCT International Patent Application No. PCT/AU2016/000209, 3 pp.

*Primary Examiner* — Stephen A Vu
(74) *Attorney, Agent, or Firm* — Nixon & Vanderhye P.C.

(57) ABSTRACT

A curtain changing apparatus and method of use thereof includes a curtain retrieval arm engageable with a curtain track to allow the transfer of a curtain between the curtain track and the curtain retrieval arm. A removable insert is adapted to bridge the full or partial cutout section of the curtain track for normal use of the track, and an insert retrieval tool is adapted to enable removal and replacement of the insert from ground level.

12 Claims, 5 Drawing Sheets

(51) Int. Cl.

| | |
|---|---|
| ***A47H 15/04*** | (2006.01) |
| ***A61G 12/00*** | (2006.01) |
| ***B25G 1/04*** | (2006.01) |
| *A47H 15/00* | (2006.01) |

(52) U.S. Cl.
CPC ..... *B25G 1/04* (2013.01); *A47H 2001/045* (2013.01); *A47H 2015/005* (2013.01)

(58) Field of Classification Search
CPC .... A47H 2001/045; B25J 1/04; A47F 5/0892; A61G 12/00; B25G 1/04
See application file for complete search history.

(56) References Cited

U.S. PATENT DOCUMENTS 5,188,332 A * 2/1993 Callas ..... G09F 7/18
248/206.5
5,330,243 A * 7/1994 Held ..... H01J 9/006
294/99.1

FOREIGN PATENT DOCUMENTS

| | | |
|---|---|---|
| DE | 3315218 A1 * | 10/1984 |
| DE | 36 07 807 | 9/1986 |
| WO | WO 01/54548 | 8/2001 |

* cited by examiner

CURTAIN CHANGING APPARATUS AND METHOD OF USE THEREOF

This application is the U.S. national phase of International Application No. PCT/AU2016/000209 filed Jun. 20, 2016 which designated the U.S. and claims priority to Australian Patent Application No. 2015902341 filed Jun. 18, 2015, the entire contents of each of which are hereby incorporated by reference.

FIELD OF THE INVENTION

The present invention relates to healthcare and hospital curtains and accessories. In particular, but not exclusively, the present invention relates to a curtain changing apparatus and method of use thereof which enables a curtain to be loaded or unloaded from a curtain track. However, it will be appreciated that the present invention has broader application and is not limited to that particular use.

BACKGROUND TO THE INVENTION

Hospital and medical curtains which are used to screen beds for screening and privacy purposes must be regularly removed and cleaned for hygiene purposes. These curtains generally comprise a curtain track, a plurality of curtain attachment elements such as hooks, eyelets or other devices which are adapted to be threaded onto the track. These curtain attachment elements can be detached from corresponding slots on the curtain. Removal and re-installation of such elements is extremely time consuming and also pose healthy and safety concerns to employees who often need to climb a ladder or the like to reach and change the curtain.

Some systems comprise a curtain changing cassette wherein the cassette is a section of track that can be removed with the curtain attached, using a spring loaded pin/unloading tool which is always at the end of the track. The dirty curtain can be removed and the cassette then introduced to the track with a clean curtain ready for immediate use. However, many of these utilise "fixed glide" systems which can get caught and stuck on track joins and cannot be used with disposable curtains.

In this specification, the terms "comprises", "comprising" or similar terms are intended to mean a non-exclusive inclusion, such that a curtain changing apparatus that comprises a list of elements does not include those elements solely, but may well include other elements not listed.

OBJECT OF THE INVENTION

It is a preferred object of the present invention to provide a curtain changing apparatus and method of use thereof, that addresses or at least ameliorates one or more of the aforementioned problems of the prior art and/or provides consumers with a useful or commercial choice.

SUMMARY OF THE INVENTION

Generally, embodiments of the present invention relate to a curtain changing apparatus and method of use thereof for changing healthcare curtains.

According to one aspect, although not necessarily the broadest aspect, the present invention resides in a curtain changing apparatus comprising:

a curtain retrieval arm engageble with a curtain track to allow the transfer of a curtain between the curtain track and the curtain retrieval arm.

Preferably, the curtain retrieval arm is telescopic having an upper arm and a lower arm slidably movable in relation to one another and locked in place via a locking mechanism to self-support on the floor.

Preferably, the curtain retrieval arm further comprises a retention means to secure the curtain retrieval arm to the curtain track.

Preferably, the retention means is in the form of one or more magnets or other suitable securing means.

Preferably, the curtain retrieval arm is adapted to be received within a full or partial cutout portion of the curtain track.

Preferably, the upper arm comprises a curved track section in the form of an elongate member having a pair of spaced apart downwardly extending flanges which form a channel.

Preferably, a pair of locator plates is secured to either side of the curved track section via at least one fastener to enable the curtain retrieval arm to be received and held within the full or partial cutout portion of the curtain track.

Preferably, the curtain changing apparatus further comprises a removable insert which is adapted to bridge the full or partial cutout section of the curtain track for normal use of the track.

Preferably, the insert comprises a retention means in the form of least one magnet or suitable latching component such that it can be secured within the full or partial cutout portion of the curtain track via attachment to a magnetic target or other suitable target.

Preferably, the insert comprises a miniature track section in the form of an extruded elongate member having a pair of spaced apart downwardly extending flanges which form a channel.

Preferably, a pair of locator plates is secured to either side of the miniature track section of the insert via at least one fastener to position the removable insert within the curtain track.

Preferably, the curtain changing apparatus further comprises an insert retrieval tool adapted to enable removal and replacement of the removable insert from ground level.

Preferably, the insert retrieval tool has at least one slotted portion for receiving and securing at least one latching member of the removable insert therein.

Preferably, the insert retrieval tool comprises an arm member and a retrieval portion attached to the top of the arm member.

Preferably, provided at the base of the arm member is a rubber stop member.

Preferably, the retrieval portion is preferably L-shaped having a base member and a side member wherein the arm member at its top end is attached to an underside of the base member and the side member has the at least one slotted portion.

Preferably, the at least one slotted portion is substantially curved.

According to another aspect, although again not necessarily the broadest aspect, the present invention resides in a method for changing a curtain whereby a curtain retrieval arm is used to transfer the curtain between a curtain track and the curtain retrieval arm.

Preferably, the method for changing a curtain further includes a removable insert which is inserted to bridge a functional full or partial cutout in the curtain track.

Preferably, the method for changing a curtain further includes an insert retrieval tool adapted to enable removal and replacement of the removable insert from ground level.

Further features and forms of the present invention will become apparent from the following detailed description.

BRIEF DESCRIPTION OF THE DRAWINGS

In order that the invention may be readily understood and put into practical effect, reference will now be made to embodiments of the present invention with reference to the accompanying drawings, wherein like reference numbers refer to identical elements. The drawings are provided by way of example only, wherein.

Figure 1:
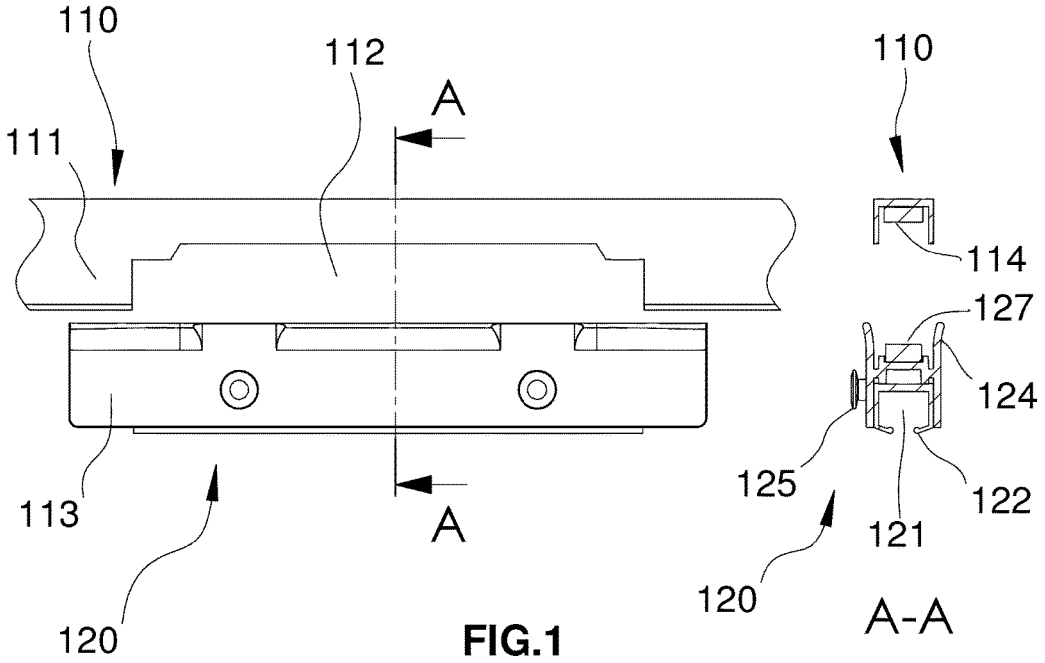
FIG. 1 shows a side cross-section view of a removable insert of a curtain changing apparatus according to an embodiment of the present invention.

Skilled addressees will appreciate that elements in the drawings are illustrated for simplicity and clarity and have not necessarily been drawn to scale. For example, the relative dimensions of some of the elements in the drawings may be distorted to help improve understanding of embodiments of the present invention.

DETAILED DESCRIPTION OF THE INVENTION

Embodiments of the present invention will be described with reference to a curtain changing apparatus which enables a curtain to be loaded or unloaded from a curtain track. For convenience sake, the curtain changing apparatus will be described herein as a device for use with medical curtains used in hospitals and other medical clinics and medical providers. However, it should be appreciated that embodiments of the present invention can be modified to suit other suitable sliding curtains and/or applications. It will be appreciated that variations may need to be made as required.

Figure 2:
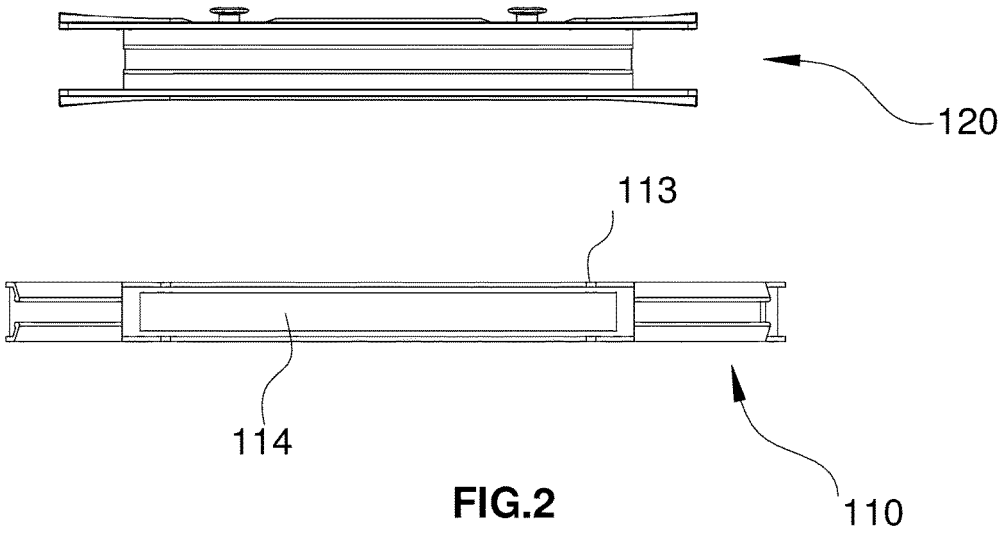
FIG. 2 shows a bottom view of the removable insert of FIG. 1 for positioning in a modified curtain track having a full or partial cutout portion.

Referring to FIGS. 1 to 7, the curtain changing apparatus is provided in accordance with embodiments of the present invention. As illustrated in FIGS. 1 and 2, the curtain changing apparatus comprises a removable insert 120 which is adapted to be received within a curtain track 110. The track 110 is an elongate member having a pair of spaced apart downwardly extending guide flanges 111 which form a channel 112 as conventionally known in the art. The track 110 is modified at a preferred position to include a full or partial cutout portion 113 which enables the insert 120 and/or a curtain retrieval arm (described in detail later) to be inserted and removed from the curtain track 110. The removable insert 120 is in the form of, but not limited to, an injection mould, which fits within, but not limited to, an aluminum extrusion full or partial cutout portion 113. It will be acknowledged that the track 110 can be installed at any suitable height, preferably ranging from two hundred and ten centimeters to three hundred centimeters high from the floor. Furthermore, it is envisaged that any suitable track in any suitable form may be adopted. In an alternative embodiment, it is envisaged that the curtain retrieval arm may be engagable with an end of the track without requiring a full or partial cutout portion.

Figure 3:
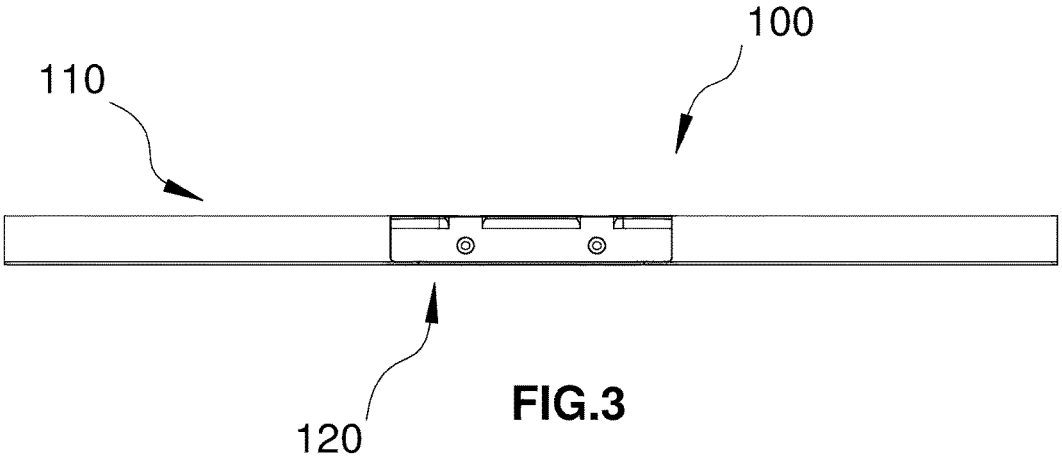
FIG. 3 shows a bottom perspective view of the removable insert of FIG. 1 inserted in the full or partial cutout portion of the modified curtain track of FIG. 2.

The removable insert 120 can be, but not limited to, one or more piece injection mould or similar configured to comprise a miniature track section 121 in the form of an extruded elongate member having a pair of spaced apart downwardly extending flanges 122 which form a channel 123. A pair of locator plates 124 can be secured to, or be integrally formed with the mould on, either side of the miniature track section. At least one latching member 125, such as a fastener in the form of a screw or bolt or part of the mould or similar or any other suitable fastening means, is provided on the insert 120. The pair of locator plates 124 is preferably slightly larger in length and height compared to the miniature track section 121. The removable insert 120 is adapted to be held within the track 110 via a retention means 127. The retention means is in the form of at least one magnet 127 or similar latching component, which is secured to a top surface of the miniature track section 121. It is envisaged that the dimensions and strength of the magnet can be varied and will be chosen to suit the size of the insert 120. A magnetic target 114, or other suitable target, is provided on an underside of the track 110 within the full or partial cutout portion 113 to enable the insert 120 to be held therein. The magnetic target 114 is in the form of a fixed steel plate to which the magnet 127 is attachable. However, any suitable form may be adopted in alternative embodiments of the invention. Once positioned within the full or partial cutout portion 113 of the curtain track 110, the miniature track section will be continuous with that of the adjacent curtain track 110 to allow normal use of the curtain track 110, as illustrated in FIG. 3.

Figure 4:
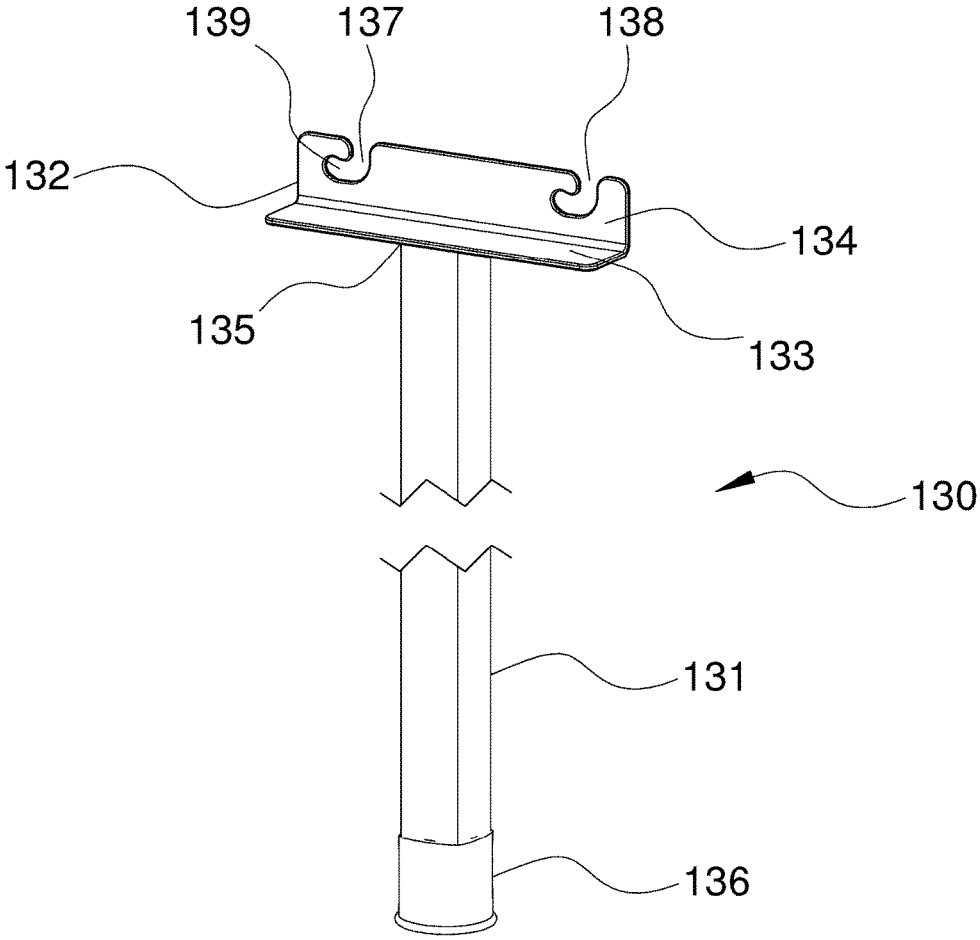
FIG. 4 shows a perspective view of an insert retrieval tool of the curtain changing apparatus according to an embodiment of the present invention.
Figure 5:
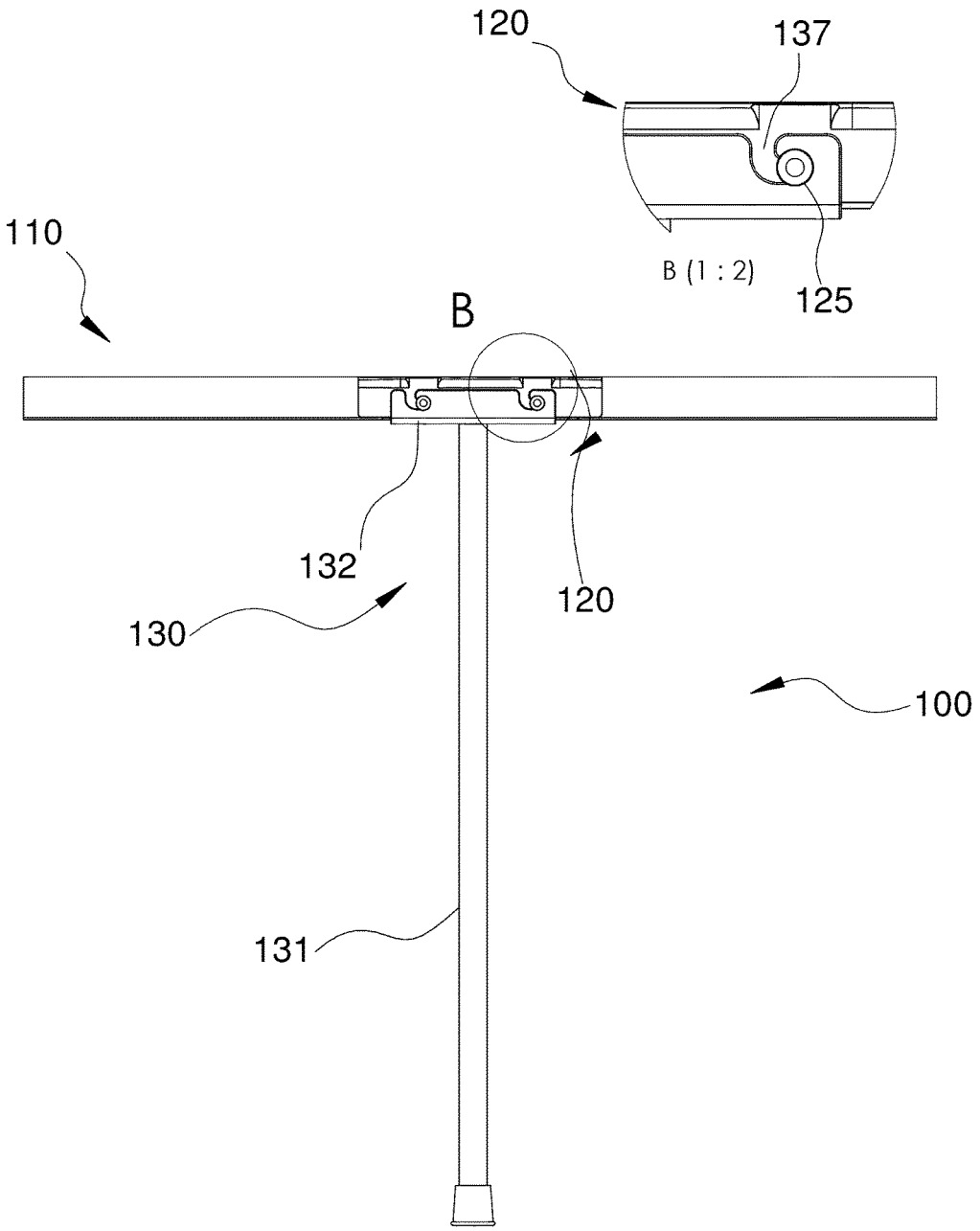
FIG. 5 shows a perspective view of the insert retrieval tool of FIG. 4 in position to retrieve the insert from the curtain track.

Referring to FIGS. 4 and 5, the curtain changing apparatus 100 comprises an insert retrieval tool 130 which is adapted to enable removal of the insert 120 and replacement of the insert 120 from ground level for normal use. The insert removal tool 130 is in the form of a T-shaped tool comprising an arm member 131 and a retrieval portion 132 attached to the top of the arm member 131 such that the retrieval portion 132 lies perpendicular to the arm member 131. It is envisaged that the arm member 131 can be provided in varied lengths and/or can be adjustable in length. Provided at the base of the arm member 131 is a rubber stop member 136. The retrieval portion 132 is preferably L-shaped having a base member 133 and a side member 134 integrally formed such that the base member 133 and a side member 134 lie at right angles to one another. The arm member 131 at its top end 135 is attached to an underside of the base member 133. The side member 134 has provided at least one slotted portion 137. According to a preferred embodiment, a pair of slotted portions 137 is provided. The pair of slotted portions 135 is substantially curved and is adapted to receive and securely hold the latching member(s) 125 of the insert 120 therein. An opening 138 of the slotted portions 137 is slightly larger in width and tapers inwardly to the body 139 of the slotted portions 137 such that the latching member can be received within the opening 138 and retained within the smaller width of the body 139 of the slotted portions 137, as illustrated in FIG. 5. It will be acknowledged that any other suitable means of connection between the insert 120 and insert retrieval tool 130 could also be adopted.

Figure 6:
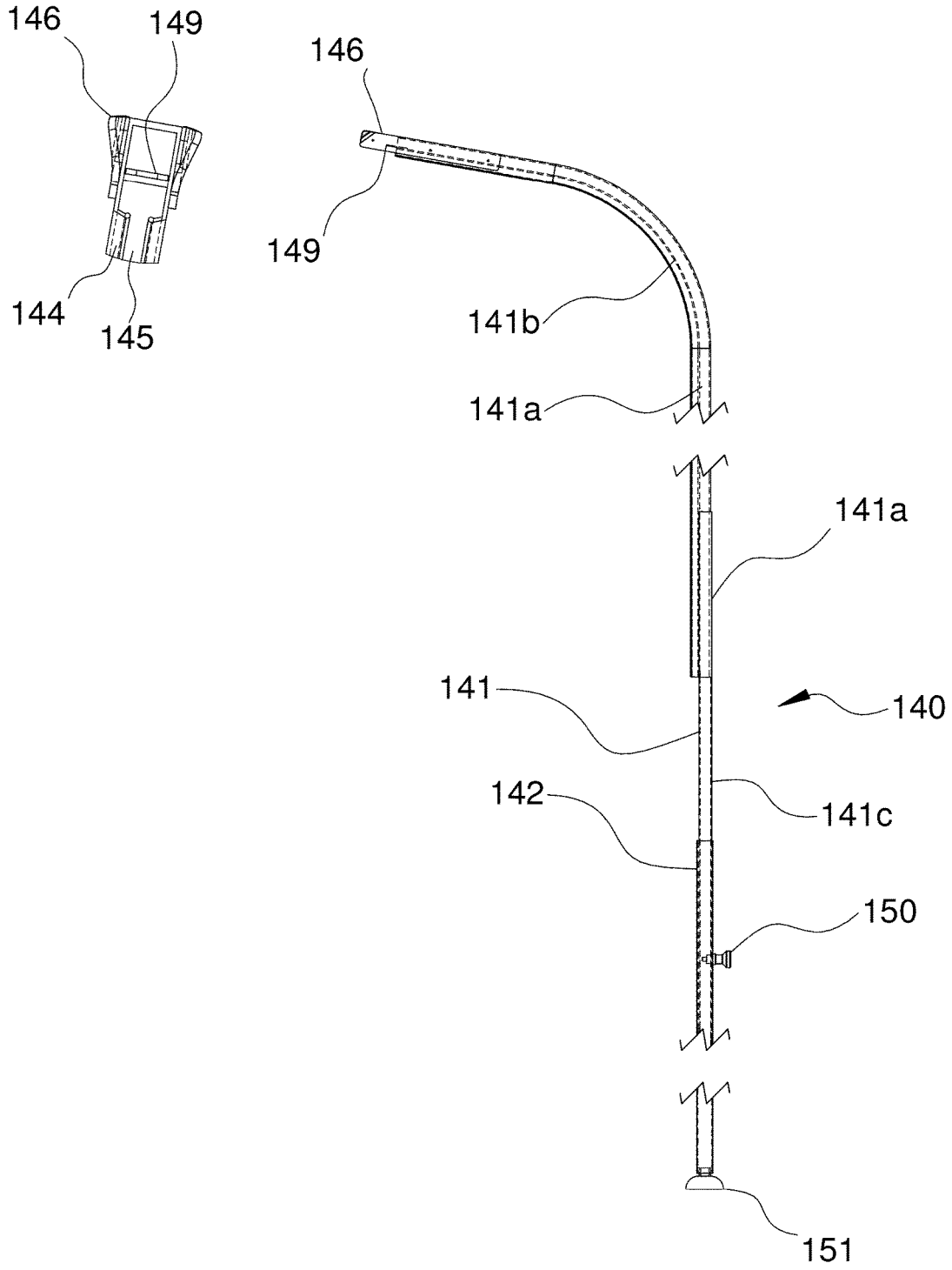
FIG. 6 shows a side view of a curtain retrieval tool of the curtain changing apparatus according to an embodiment of the present invention.

Referring to FIG. 6, the curtain changing apparatus 100 comprises a curtain retrieval arm 140. The curtain retrieval arm 140 comprises an upper arm 141 and a lower arm 142. Provided at the base of the lower arm 142 is a stopper member 151. The upper arm 141 comprises a straight portion 141*a* and a curved section of track 141*b*. The curved section of track 141*b* of the upper arm 141 comprises an extruded elongate member having a pair of spaced apart downwardly extending flanges 144 which form a channel 145. A pair of locator plates 146 is secured to either side of the curved track section 141*b* via at least one fastener which passes through corresponding apertures provided in the locator plates 146 and curved track section 141*b*. The at least one fastener can be a screw or bolt or any other suitable fastening means. A retention means 149 is provided within the curved track section 141*b* positioned between the locator plates 146 to enable the curtain retrieval arm 140 to be received and held within the full or partial cutout portion 113 of the track 110.

The curtain retrieval arm 140 is telescopic to be adaptable to suit tracks mounted at different heights curtains mounted at different heights whereby the upper arm 141 and lower arm 142 can be slidably moved in relation to each other. The upper arm 141 comprises a shaft 141*c* which is adapted to be slidably received within the lower arm 142. As illustrated in FIG. 6, a locking mechanism 150, such as a knob or the like, is provided which is adapted to lock the upper arm 141 within the lower arm 142. The securing/release device 150 is in the form of a screw knob which is movable between a first locked position wherein the button extends through at least one corresponding aperture provided on the upper arm 141 and lower arm 142 and a second unlocked position wherein the securing/release knob is retracted from the at least one aperture provided on the upper arm 141, and possibly but not necessarily the lower arm 142, to enable the lower arm 142 to be slidably movable relative to the upper arm 141 of the curtain retrieval arm 140, to compliment varying track types and installation heights. However, in an alternative embodiment is it envisaged that any other suitable locking means could be utilised such as, a depressible button or the like.

Figure 7:
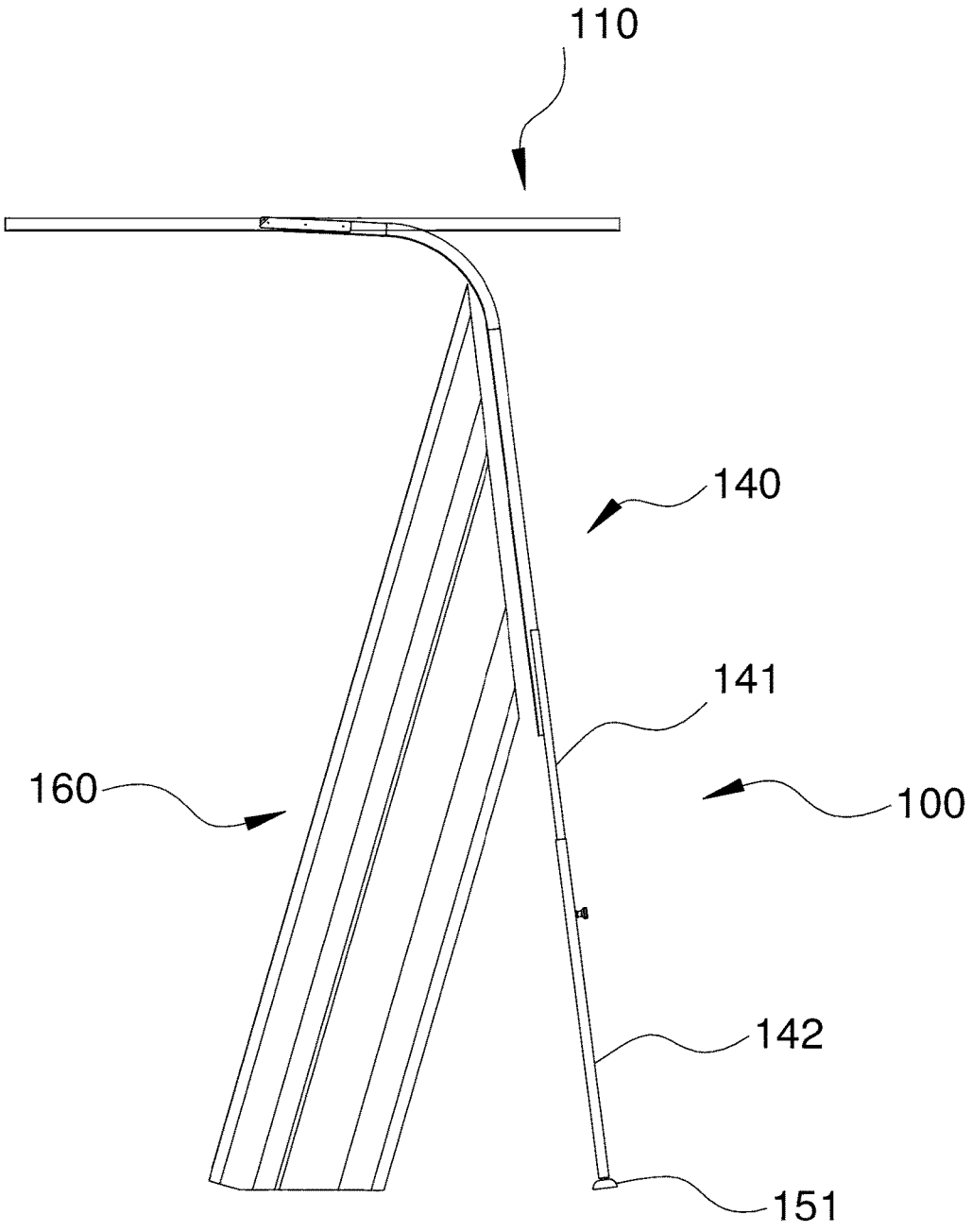
FIG. 7 shows a perspective view of the curtain retrieval tool of FIG. 6 in position to remove a curtain.

A method of changing the curtain using the curtain changing apparatus 100 of the present invention is provided. The insert 120 is removed from the track 110 using the insert retrieval tool 130. To remove the insert 120, the pair of latching members 125 on the insert 120 is aligned with the slotted portions 137 on the insert retrieval tool 130. The insert retrieval tool 130 is then pushed in an upward direction followed by a sideward direction, dependent on the shape of the slotted portions 137, such that the fasteners 125 are received and secured/locked within the slotted portions 137. When the insert 120 is firmly secured within the insert retrieval tool 130, the insert retrieval tool 130 can then be pulled downwardly to release the magnetic force and remove the insert 120 from the curtain track 110. Once the insert 120 is removed, the curtain retrieval arm 140 can be inserted into the track 110. The height of the curtain retrieval arm 140 can then be adjusted and locked into place from ground level utilising the locking mechanism 150 on the curtain retrieval arm 140. When the curtain retrieval arm 140 is securely in position, a "dirty" curtain can be pulled into the curtain retrieval arm 140 which enables the curtain to drop down to a waist height position where the "dirty" curtain 160 can easily and safely be unhooked for cleaning and a "clean" curtain can be hooked and slotted back into the curtain retrieval arm 140 to be dragged up onto the track 110, as illustrated in FIG. 7. The curtain retrieval arm 140 is then removed and the insert 120 replaced back into its normal position for daily use.

It is envisaged that the curtain changing apparatus will be provided in two forms. A retrofit form, as detailed above, to accommodate existing tracking external dimensions and wheeled curtain hooks by removing a section of the existing track and joining an equivalent length section of track to accommodate the interchangeable insert of the present invention. In an alternative embodiment, a new installation form will have a larger wheeled curtain hook to eliminate snagging of the hook on the track joins, which is a common issue in current installations. Accordingly, the external dimension of the track will match existing commercially available tracks while the internal dimension of the track and channel can be enlarged to accommodate a larger wheeled curtain hook.

Hence, the curtain changing apparatus provides a solution to the aforementioned problems of the prior art by providing a curtain changing apparatus which enables a curtain to be loaded or unloaded from a curtain track in any position in the girth of the track, enabling access in the centre of rooms with trolleys holding clean curtains and not limited to the end of tracks in the corner of rooms, as per current products. The curtain changing apparatus of the present invention enables the use of commonly available swivel wheeled carriers as opposed to "fixed glides" which catch on track joins and cannot be used with current "disposable" curtains. The curtain retrieval arm of the present invention does not need to be held and once it has been slotted into the curtain track and its height is adjusted and locked to suit the height between the curtain track and the floor, the curtain retrieval arm will be freestanding avoiding the need to support the weight of the arm and curtain which would otherwise require support. The present invention enables the changing of healthcare curtains from a standing ground-based position without the need to reach and climb and stand or steps or ladders or the like that could lead to injury.

The reference to any prior art in this specification is and should not be taken as, an acknowledgment or any form or suggestion that the prior art forms part of the common general knowledge.

Throughout the specification the aim has been to describe the invention without limiting the invention to any one embodiment or specific collection of features. Persons skilled in the relevant art may realize variations from the specific embodiments that will nonetheless fall within the scope of the invention.

I claim:

1. A curtain changing apparatus comprising:

a free-standing telescopic curtain retrieval arm engageable with a curtain track having an upper arm and a lower arm slidably moveable in relation to one another, wherein the upper arm comprises a curved track section in the form of an extruded elongate member having a pair of spaced apart downwardly extending flanges which form a channel;

a retention structure provided on the upper arm to secure the curtain retrieval arm within the curtain track;

a stopper member provided on the base of the curtain retrieval arm to self-support the apparatus on the floor in a sloped configuration relative to curtain track; and wherein the sloped configuration of the curtain changing apparatus allows the direct transfer of a curtain between the curtain track and the curtain retrieval arm by hand.

2. The curtain changing apparatus of claim 1, wherein the curtain retrieval arm is adapted to be received within a full or partial cutout portion of the curtain track.

3. The curtain changing apparatus of claim 1, wherein a pair of locator plates are secured to either side of the curved track section via at least one fastener to enable the curtain retrieval arm to be received and held within the full or partial cutout portion of the curtain track.

4. The curtain changing apparatus of claim 1, further comprising a removable insert which is adapted to bridge the full or partial cutout section of the curtain track for normal use of the track.

5. The curtain changing apparatus of claim 4, wherein the removable insert comprises the retention structure in the form of least one magnet or suitable latching component such that it can be secured within the full or partial cutout portion of the curtain track via attachment to a magnetic target or other suitable target.

6. A curtain changing apparatus comprising:

a free-standing telescopic curtain retrieval arm engageable with a curtain track having an upper arm and a lower arm slidably moveable in relation to one another;

a retention structure provided on the upper arm to secure the curtain retrieval arm within the curtain track;

a stopper member provided on the base of the curtain retrieval arm to self-support the apparatus on the floor in a sloped configuration relative to curtain track; and a removable insert which is adapted to bridge the full or partial cutout section of the curtain track for normal use of the track, wherein the sloped configuration of the curtain changing apparatus allows the direct transfer of a curtain between the curtain track and the curtain retrieval arm by hand, and wherein the removable insert comprises a miniature track section in the form of an extruded elongate member having a pair of spaced apart downwardly extending flanges which form a channel.

7. The curtain changing apparatus of claim 6, wherein a pair of locator plates is secured to either side of the miniature track section of the removable insert via at least one fastener to position the insert within the curtain track.

8. A curtain changing apparatus comprising:

a free-standing telescopic curtain retrieval arm engageable with a curtain track having an upper arm and a lower arm slidably moveable in relation to one another;

retention structure provided on the upper arm that is configured to secure the curtain retrieval arm within the curtain track;

a stopper member provided on the base of the curtain retrieval arm to self-support the apparatus on the floor in a sloped configuration relative to curtain track;

a removable insert which is adapted to bridge the full or partial cutout section of the curtain track for normal use of the track; and an insert retrieval tool adapted to enable removal and replacement of the removable insert from ground level, wherein the sloped configuration of the curtain changing apparatus allows the direct transfer of a curtain between the curtain track and the curtain retrieval arm by hand.

9. The curtain changing apparatus of claim 8, having at least one slotted portion for receiving and securing at least one latching member of the removable insert therein.

10. The curtain changing apparatus of claim 9, wherein the insert retrieval tool comprises an arm member and a retrieval portion attached to the top of the arm member.

11. The curtain changing apparatus of claim 10, wherein the retrieval portion is preferably L-shaped having a base member and a side member wherein the arm member at its top end is attached to an underside of the base member and the side member has the at least one slotted portion.

12. The curtain changing apparatus of claim 11, wherein the at least one slotted portion is substantially curved.

* * * * *